US007708599B2

(12) United States Patent
Guan et al.

(10) Patent No.: US 7,708,599 B2
(45) Date of Patent: May 4, 2010

(54) CARD EDGE CONNECTOR WITH POWER CONTACTS

(75) Inventors: Hai-Fei Guan, Kunshan (CN); Xue-Wu Bu, Kunshan (CN); Ting-Shun Liu, Kunshan (CN)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/549,588

(22) Filed: Aug. 28, 2009

(65) Prior Publication Data

US 2010/0062648 A1 Mar. 11, 2010

(30) Foreign Application Priority Data

Sep. 8, 2008 (CN) ..... 200820185545

(51) Int. Cl.
*H01R 24/00* (2006.01)

(52) U.S. Cl. ..... 439/636; 439/637

(58) Field of Classification Search ..... 439/636, 439/637

See application file for complete search history.

(56) References Cited

U.S. PATENT DOCUMENTS

| | | | | |
|---|---|---|---|---|
| 5,919,049 | A | 7/1999 | Petersen et al. | |
| 6,254,435 | B1 * | 7/2001 | Cheong et al. | 439/637 |
| 6,296,491 | B1 * | 10/2001 | Pickles | 439/637 |
| 6,358,061 | B1 * | 3/2002 | Regnier | 439/637 |

* cited by examiner

*Primary Examiner*—Tho D Ta
(74) *Attorney, Agent, or Firm*—Wei Te Chung; Andrew C. Cheng; Ming Chieh Chang

(57) ABSTRACT

A card edge connector (100) includes an elongate insulative housing (1), a plurality of signal contacts (3) and a pair of power contacts (4) retained in the insulative housing (1). The insulative housing (1) defines a pair of opposed side walls (11) and a central slot (13) between the side walls (11). Each side wall (11) defines a plurality of passageways (110) communicating with the central slot (13). Each signal contact (3) has an engaging portion (32) exposed to the central slot (13.) Each power contact (4) has a securing portion (41) retained in the insulative housing (1), a plurality of contact portions (42) extending upwardly and sidewardly into the central slot (13) from the securing portion (41) and arranged in a row along a length direction of the insulative housing (1), and at least one tail portion (43) extending downwardly from another end of the securing portion (41).

15 Claims, 6 Drawing Sheets

FIG. 3

CARD EDGE CONNECTOR WITH POWER CONTACTS

BACKGROUND OF THE INVENTION

1. Field of the Invention

The present invention relates to card edge connectors, more particularly to card edge connectors with power contacts.

2. Description of Related Art

Card edge connectors are employed widely in computers to receive a memory card for increasing memory capacity of the computers. With rapid development of electronic industry, the computer has a rapid speed of data operation, and need a mass of electric current to supply the data operation. Therefore, the card edge connector is arranged with a plurality of power contacts to supply added transmission channels for transmitting a mass of current to the computer. However, when the power contacts have been added into the card edge connector, the impedance of contacts in the card edge connector is increased at the same time, therefore, the power contacts will produce more heat when a mass of current transfluxes the power contacts, and affect the signal transmission stability of card edge connector.

Hence, an improved card edge connector is desired to overcome the above problems.

BRIEF SUMMARY OF THE INVENTION

According to one aspect of the present invention, a card edge connector comprising: an elongate insulative housing defining a pair of opposed side walls and a central slot between the side walls, each side wall defining a plurality of passageways communicating with the central slot; a plurality of signal contacts retained in the passageways, each signal contact having a contact portion exposed to the central slot; and at least a power contact retained in the insulative housing, the power contact having a securing portion retained in the insulative housing, a plurality of contact portions extending upwardly and sidewardly into the central slot from one end of the securing portion and arranged in a row along a length direction of the insulative housing, and at least one tail portion extending downwardly from another end of the securing portion.

According to another aspect of the present invention, a card edge connector defining a central slot to receive a memory card, comprising: an elongate insulative housing having a pair of opposed side walls, the central slot is formed between the side walls, each side wall defines a plurality of passageways; a plurality of signal contacts retained in the passageways, each signal contact having a contact portion extending into the central slot; and a plurality of power contacts arranged in two rows respectively retained in two side walls of the insulative housing, each power contact has a securing portion, a contact portion extending upwardly and sidewardly from one end of the securing portion, and a tail portion extending downwardly from another end of the securing portion. The securing portions of the power contacts in each row are connected with each other.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
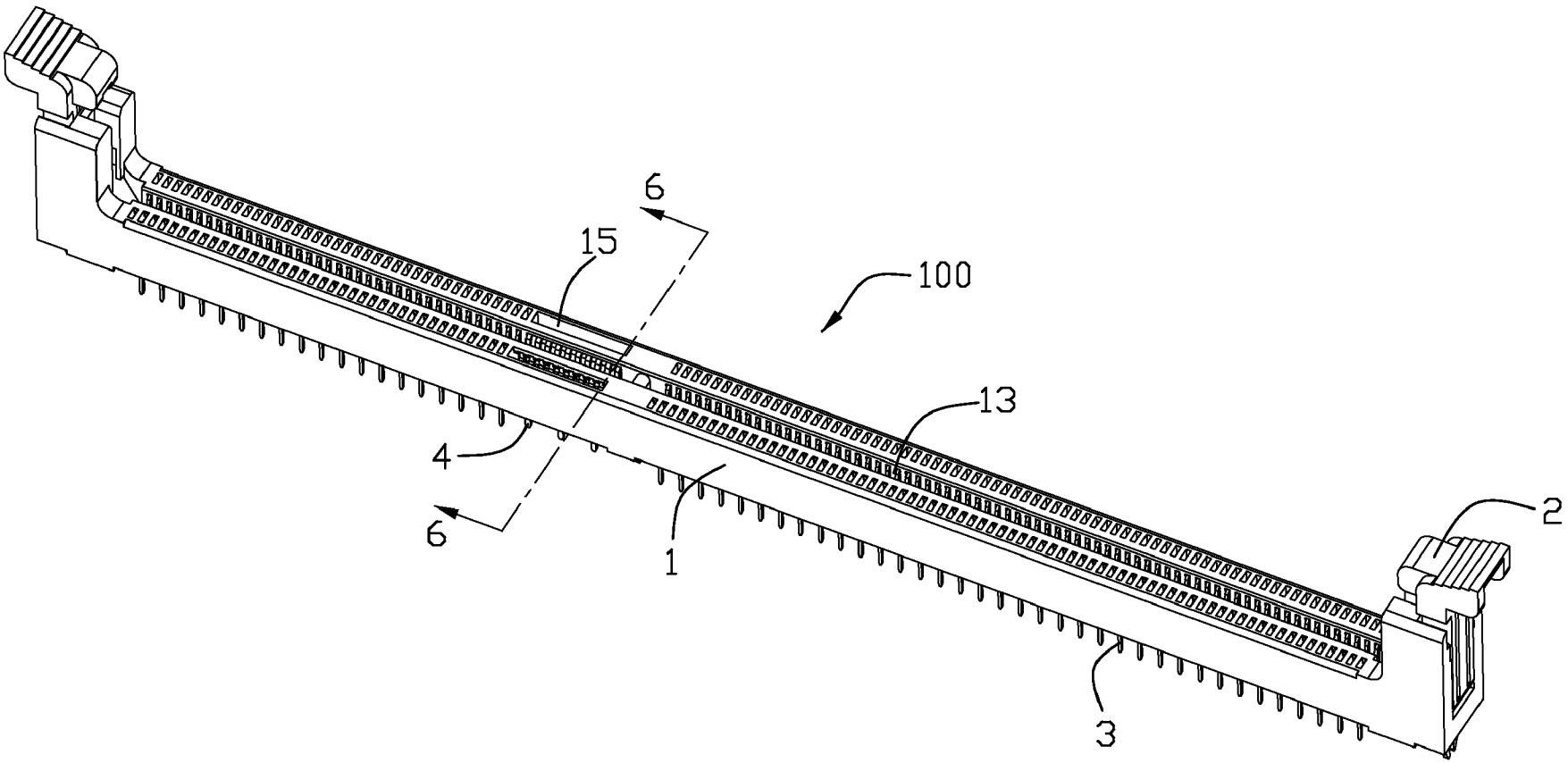
FIG. 1 is a perspective view of a card edge connector according to the present invention.
Figure 2:
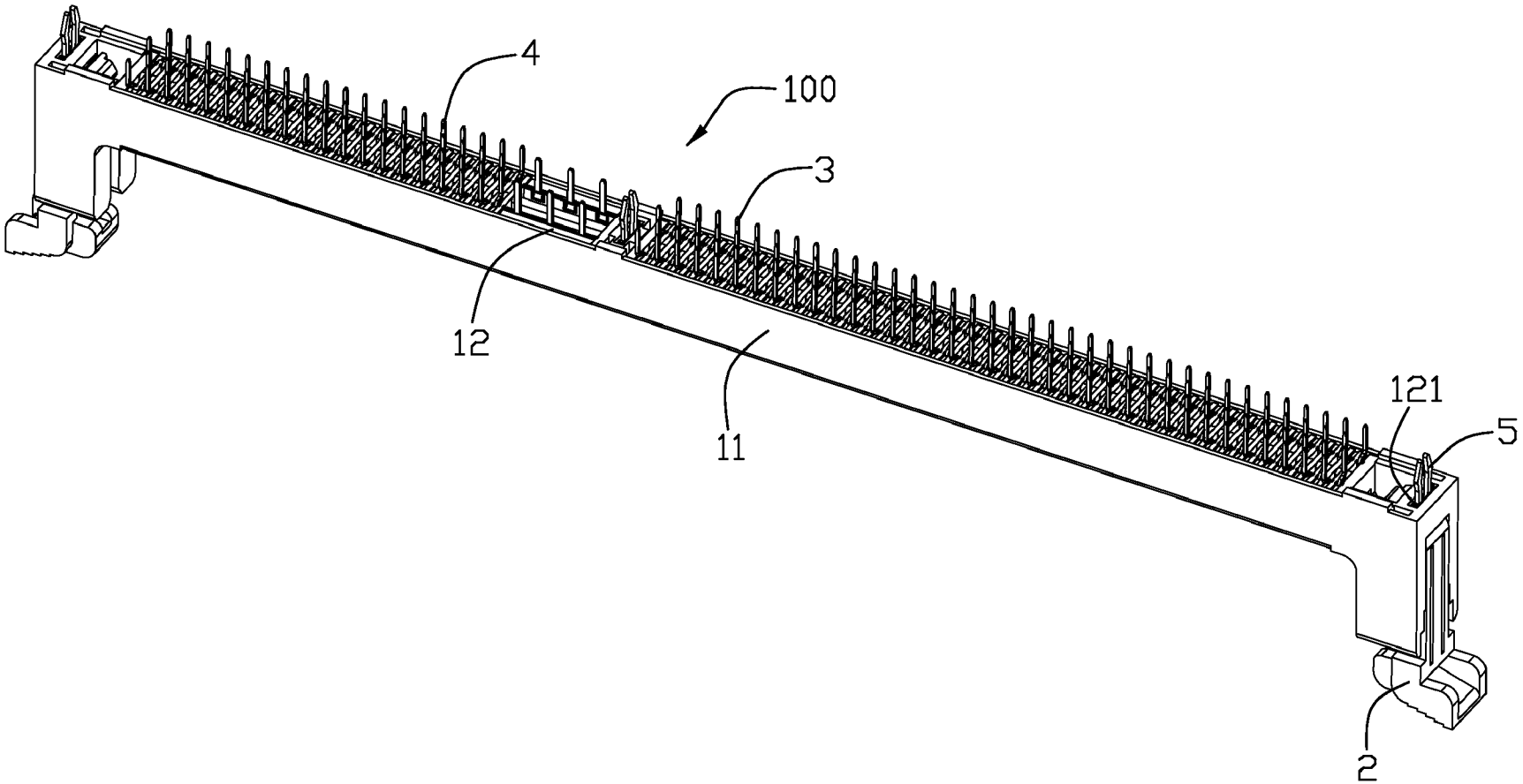
FIG. 2 is a view similar to FIG. 1, while taken from a different aspect.
Figure 3:
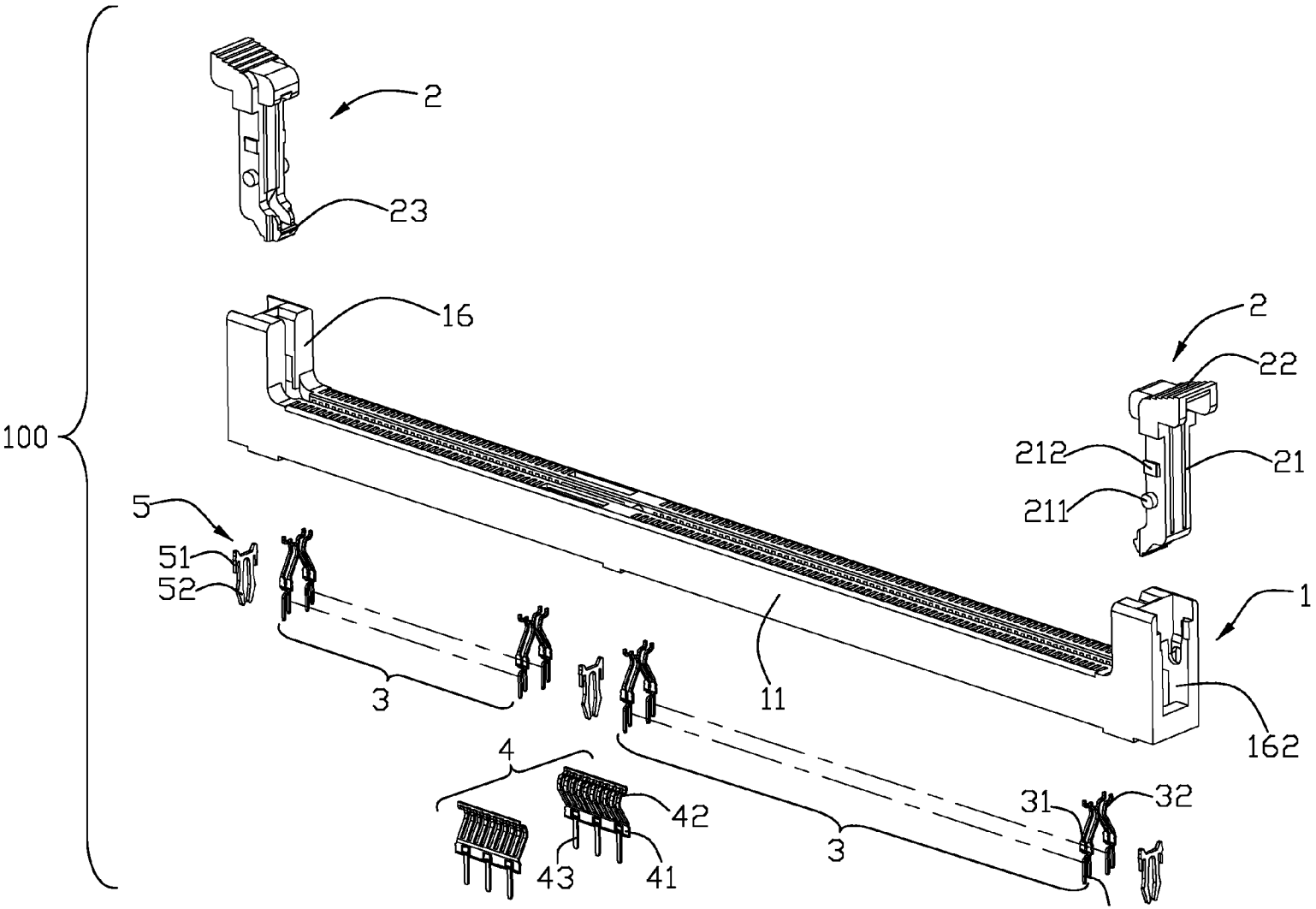
FIG. 3 is an exploded perspective view of the card edge connector shown in FIG. 1.
Figure 4:
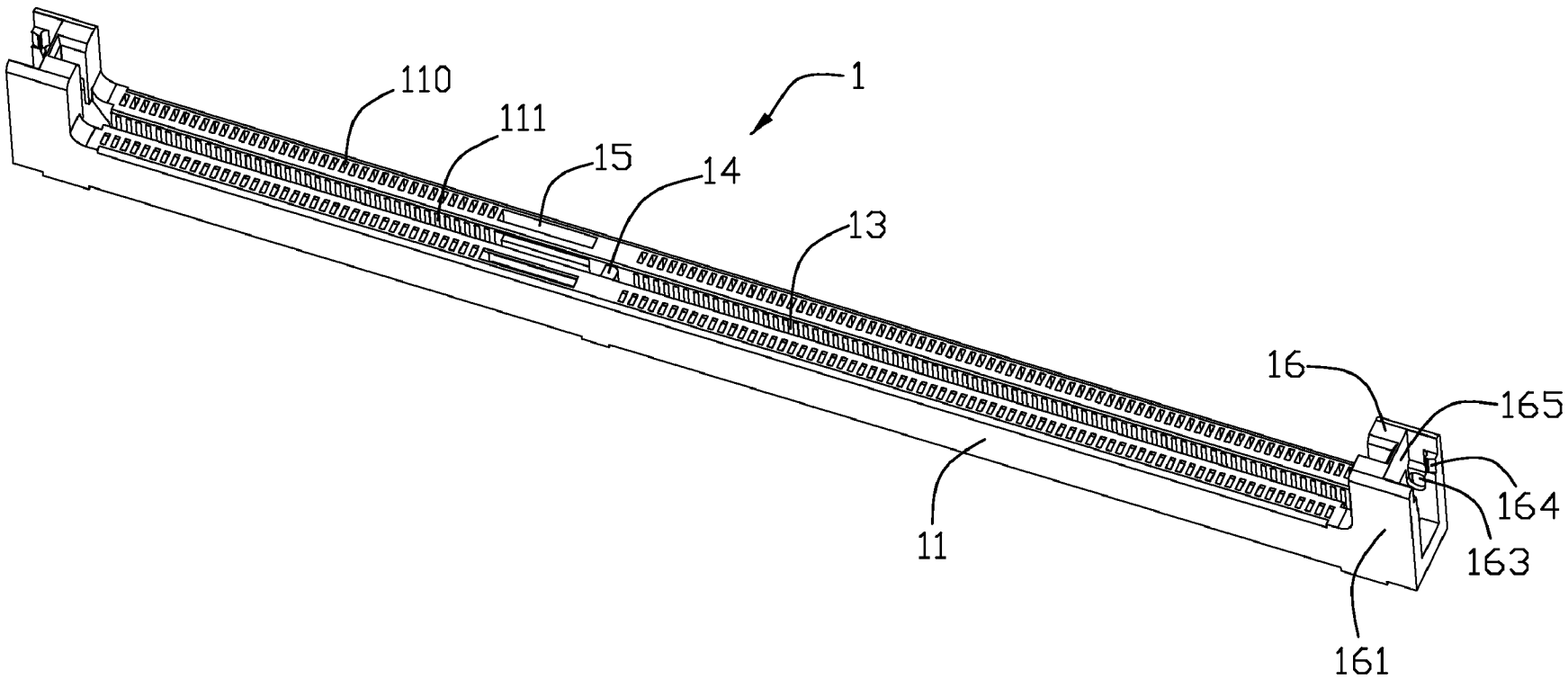
FIG. 4 a perspective view of an insulative housing of the card edge connector shown in FIG. 1.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Referring to FIGS. 1-6, a card edge connector 100 according to the present invention is disclosed. The card edge connector 100 comprises an elongate insulative housing 1, a pair of ejectors 2 retained in two ends of the insulative housing 1, a plurality of signal contacts 3 and a pair of power contacts 4 retained in the insulative housing 1, and a plurality of board locks 5 retained in the insulative housing 1 for fastening the card edge connector 100 to a circuit board (not shown).

The insulative housing 1 has a pair of opposed side walls 11 extending along a length direction of the insulative housing 1, a bottom wall 12, and a central slot 13 extending along the length direction for receiving an edge portion of a memory card (not shown). Each side wall 11 defines a plurality of passageways 12 extending there through along a height direction of the insulative housing 1 for retaining the signal contacts 3, and a plurality of through holes 111 at an inner side thereof for communicating the passageways 12 and the central slot 13 together. The insulative housing 1 has a separated board 14 in the central slot 13 to separate the central slot 13 in two slots which have different length for preventing the memory card from mismating. Each side wall 11 defines a groove 15 adjacent to the separated board 14 along the length direction and communicating with the central slot 13. The groove 15 defines a width which is larger than that of the passageway 12 along the length direction.

The insulative housing 1 has a pair of opposed tower portions 16 at two ends thereof. Each tower portion 16 has a pair of opposed arm portions 161 and two receiving cavities 162 between the arm portions 161 to receive the ejectors 2. Each arm portion 161 defines a circular recess 163 at an inner side thereof and a locking block 164 extending to the receiving cavity 162 at an upper and outer side of the recess 163 for locking the ejector 2 when the memory card is inserted into the central slot 13. Each tower portion 16 has a limiting wall 165 in the receiving cavity 162 for preventing the ejector 2 from rotating overly. The receiving cavities 162 communicate with the central slot 13, therefore, the ejector 2 can extends into the central slot 13 to push the memory card out of the central slot 13. The bottom wall 12 defines a plurality of slits 121 extending along a width direction of the insulative housing 1. Each board lock 5 has a retaining portion 15 retained in the slits 121 and a pair of mounting legs 52 extending downwardly and out of the bottom wall 12.

Each signal contact 3 has a retention portion 31 retained in the passageway 110, an engaging portion 31 extending upwardly from the retention portion 31 and a soldering portion 33 extending downwardly and out of the insulative housing 1. The engaging portions 31 extend into the central slot 13 through the through holes 111 for engaging with the memory card.

Figure 5:
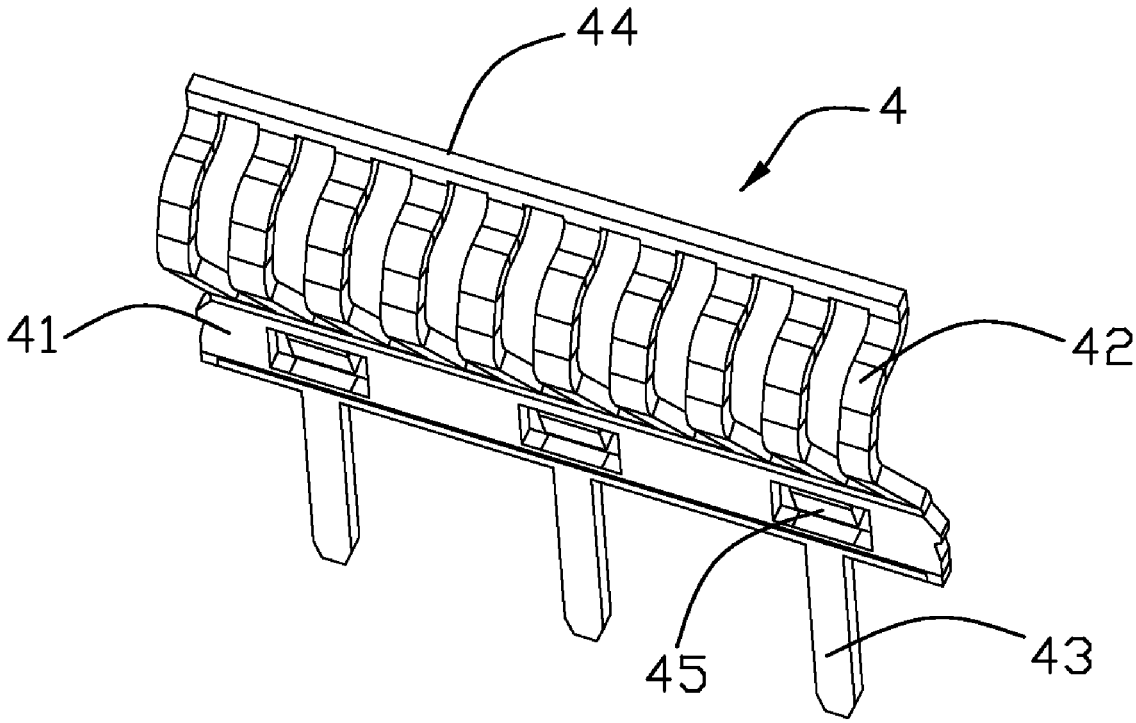
FIG. 5 is a perspective view of a power contact of the card edge connector shown in FIG. 1.
Figure 6:
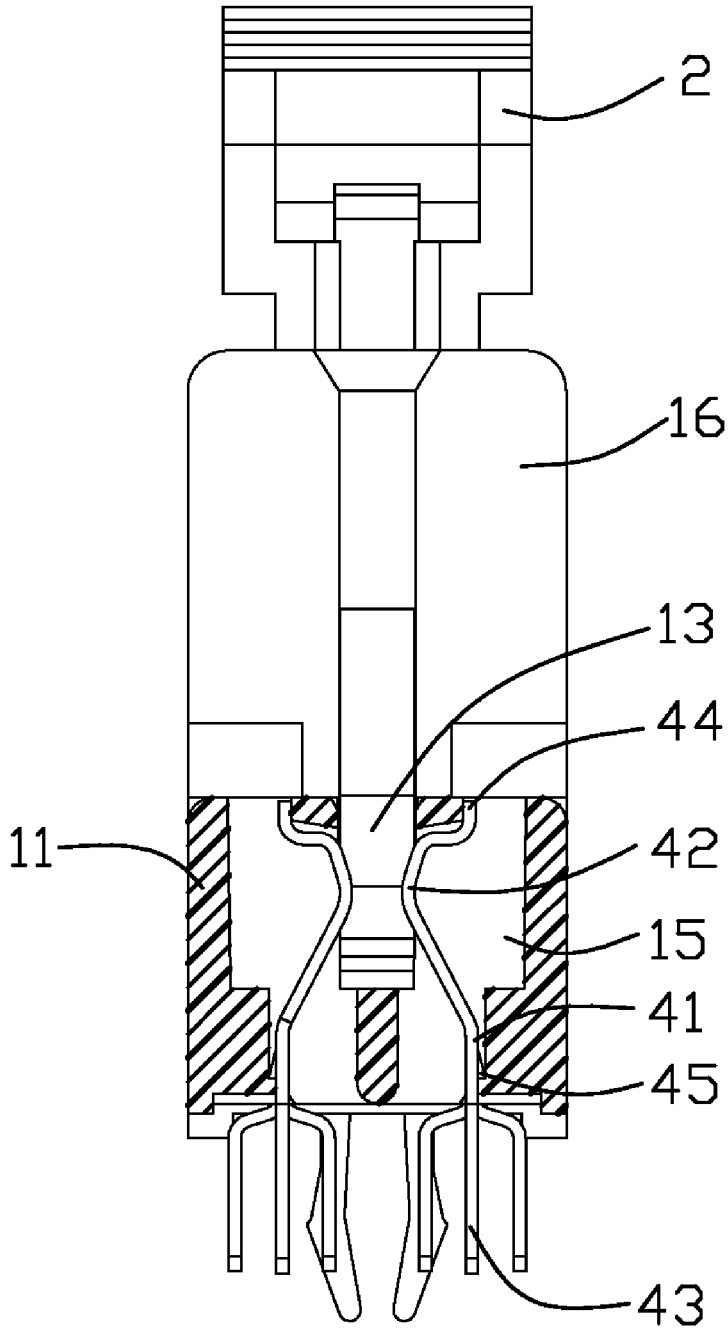
FIG. 6 is a cross-sectional view taken along line 6-6 of FIG. 1.

The pair of power contacts 4 are retained in the grooves 15 and oppose to each other. Referring to FIG. 5, each power contact 4 is stamped from a piece of metal sheet and has an elongate securing portion 41 extending along the length direction, a plurality of contact portions 42 extending upwardly and sidewardly from one end of the securing portion 41, and three tail portions 43 extending downwardly and out of the bottom wall 12 from another end of the securing portion 41 and being perpendicular to the securing portion 41.

The contact portions 42 of each power contact 4 are arranged in a row and spaced apart from each other along the length direction. The contact portions 42 connect with each other by the securing portion 41 at lower ends thereof, and by a connecting portion 44 at upper ends thereof. The contact portions 42 extend into the central slot 13 for contacting the memory card. The securing portion 41 has a plurality of retention strips 45 extending sidewardly for resisting side walls of the groove 15. The connecting portion 44 is parallel to the securing portion 41. The securing portion 41 abuts against an inner side wall of the groove 15, and the connecting portion 44 abuts against another inner side wall opposed to that of the securing portion 41 abuts against. The three tail portions 43 in each power contact 4 are offset from the contact portions 42 along the width direction of the insulative housing 1. In practice, each power contact 4 can alternatively has only one tail portion 43 or more tail portions 43 according to circuit of the circuit board.

According to the structures of two power contacts 4 described above, the power contacts 4 can be also understand as connecting a plurality of separated power contacts 4 together by the securing portion 41 and connecting portion 44. The plurality of power contacts 4 can be arranged in two rows which are respectively retained in two side walls 11 of the insulative housing 1. Each power contact 4 has a securing portion 41 retained in the groove 15, a contact portion 42 extending upwardly and sidewardly from one end of the securing portion 41, and a tail portion 43 extending downwardly from another end of the securing portion 41. The power contacts 4 in each row are connected with each other by a securing portion 41 at a lower end of the contact portions 42, and by a connecting portion 44 at an upper end of the contact portions 42. The tail portions 43 of the power contacts 4 in each row can be used in common, thereby, the power contacts 4 in each row can alternatively comprise only one or more tail portions 43 which is fewer than the contact portions 42 in a row.

Each ejector 2 has a body portion 21, a operation portion 22 at a top portion thereof, and a resisting portion 23 at a lower portion thereof for pushing the memory card out of the central slot 13. The body portion 21 has two pivots 211 at two sides thereof to engage with the recesses 163 of the arm portions 163, and two projections 212 at an upper position of the pivots 211 for locking with the locking blocks 164.

As fully described above, the power contacts 4 are added in the electrical connector 100 in the present invention to supply a plurality of transmission channels for transmitting a mass of current. In addition, the power contacts 4 in a row are connected with each other, thereby, the impedance of all power contacts 4 in a row is decreased, and heat produced in current transmission process on the power contacts 4 are decreased at the same time. The card edge connector 100 in the present invention can be worked stably.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A card edge connector comprising:

an elongate insulative housing defining a pair of opposed side walls and a central slot between the side walls, each side wall defining a plurality of passageways communicating with the central slot;

a plurality of signal contacts retained in the passageways, each signal contact having an engaging portion exposed to the central slot; and at least a power contact retained in the insulative housing, the power contact having a securing portion retained in the insulative housing, a plurality of contact portions extending upwardly and sidewardly into the central slot from one end of the securing portion and arranged in a row along a length direction of the insulative housing, and at least one tail portion extending downwardly from another end of the securing portion;

wherein the insulative housing defines a groove communicating with the central slot to fasten the power contact, the groove defines a width which is larger than that of the passageway along the length direction;

wherein the contact portions of the power contact are spaced apart from each other and connect with each other by the securing portion at one end thereof, and connect with each other by a connecting portion at another end opposite to the securing portion thereof.

2. The card edge connector as claimed in claim 1, wherein the securing portion has a plurality of retention strips extending sidewardly.

3. The card edge connector as claimed in claim 1, wherein the connecting portion is parallel to the securing portion, and the tail portion is perpendicular to the connecting portion and the securing portion.

4. The card edge connector as claimed in claim 1, wherein the insulative housing has a separated board located in the central slot for separating the central slot in two slots which have different length, the groove is adjacent to the separated board along the length direction.

5. The card edge connector as claimed in claim 1, wherein the power contact has three tail portions which are offset from the contact portions along both a height direction and a width direction of the insulative housing.

6. The card edge connector as claimed in claim 1, wherein the insulative housing has a pair of tower portions at two ends thereof, each tower portion defines a pair of arm portions and a receiving cavity between two arm portions to receive an ejector.

7. The card edge connector as claimed in claim 1, wherein the securing portion abuts against an inner side wall of the groove, and the connecting portion abuts against another inner side wall opposed to that of the securing portion abuts against.

8. The card edge connector as claimed in claim 7, wherein the card edge connector comprises a pair of the power contacts, the pair of power contacts are opposed to each other.

9. A card edge connector defining a central slot to receive a memory card, comprising:

an elongate insulative housing having a pair of opposed side walls, the central slot is formed between the side walls, each side wall defines a plurality of passageways;

a plurality of signal contacts retained in the passageways, each signal contact having an engaging portion extending into the central slot; and a plurality of power contacts arranged in two rows respectively retained in two side walls of the insulative housing, each power contact has a securing portion, a contact portion extending upwardly and sidewardly from one end of the securing portion, and a tail portion extending downwardly from another end of the securing portion;

wherein the securing portions of the power contacts in each row are connected with each other;

wherein each row of the power contacts has a connecting portion at a top end thereof to connect the power contacts with each other.

10. The card edge connector as claimed in claim 9, wherein each side wall defines a groove communicating with the central slot to fasten a row of power contacts, the securing portion has a plurality of retention strips for engaging with inner wall of the groove.

11. The card edge connector as claimed in claim 9, wherein the power contacts in a row has three tail portions in common.

12. A card edge connector comprising:

an elongated insulative housing defining therein in a longitudinal direction an elongated central slot communicating with an exterior via a mating face of said housing in a vertical direction perpendicular to said longitudinal direction;

two rows of contacts disposed in corresponding passageways of the housing and located by two sides of the central slot, each of said contacts defining a contacting section for mating with a complementary connector and a mounting section for mounting to a printed circuit board; and some selected and sequential contacts in an area in each row being unified together via a first transverse bar at free ends adjacent to said mating face, and a second transverse bar between the contacting section and the mounting sections; wherein a partition transverse wall located between every adjacent two passageways in said area and extending in a transverse direction perpendicular to both said vertical direction and said longitudinal direction, is removed for widening the contact sections of said some contacts.

13. The card edge connector as claimed in claim 12, wherein an interior wall between said passageways and the central slot in said transverse direction and in said area is completely removed for facilitating extension of said widened contact sections of said some contacts.

14. The card edge connector as claimed in claim 12, wherein said second transverse bar forms at least one embossment protruding in said transverse direction for retention to the housing.

15. The card edge connector as claimed in claim 12, wherein the contacts of a same row form the mounting sections in two lines except said some contacts, of which the mounting sections in another line between said two lines.

* * * * *